US006123045A

United States Patent [19]

Prongay

[11] Patent Number: 6,123,045

[45] **Date of Patent: *Sep. 26, 2000**

[54] BOAT DOCKING LINE HOLDER

[76] Inventor: Edward Prongay, 171 Driftway Rd., Howell, N.J. 07731

[ * ] Notice: This patent is subject to a terminal disclaimer.

[21] Appl. No.: 07/419,464

[22] Filed: Oct. 10, 1989

[51] Int. Cl.[7] ..... B63B 21/00

[52] U.S. Cl. ..... 114/230; 114/368

[58] Field of Search ..... 114/230, 361, 114/368, 369; 248/276, 280.1, 289.1

[56] References Cited

U.S. PATENT DOCUMENTS

| | | | |
|---|---|---|---|
| 3,151,595 | 10/1964 | Stainbrook | 114/230 |
| 3,183,877 | 5/1965 | Benzel | 114/230 |
| 3,187,707 | 6/1965 | Carbone | 114/230 |
| 3,195,498 | 7/1965 | Johns | 114/230 |
| 3,280,784 | 10/1966 | Stainbrook | 114/230 |
| 3,307,514 | 3/1967 | Young | 114/230 |

*Primary Examiner*—Jesus D. Sotelo

[57] ABSTRACT

A device for dock storage and boat accessible retrieval of a boat docking line is disclosed which provides safe and convenient means of docking and undocking a boat. The device generally comprises a pedestal that is fixedly attachable to a dock and an arm rotatably attached to the upper end of said pedestal, said arm including a hook disposed at the distal end of said arm for receipt of a docking line.

4 Claims, 1 Drawing Sheet

BOAT DOCKING LINE HOLDER

BACKGROUND OF THE INVENTION

The present invention generally relates to boat docking. More specifically, the present invention relates to devices for storage and retrieval of a boat docking line.

A present difficulty in docking and undocking of a boat is that at least two persons are required or a person must jump from the dock to a boat while holding the docking line. The danger of tripping over loosely strewn docking lines and the inconvenience of dropping docking lines into the water are problems also widely recognized by the boating public. These problems are overcome by the invention of the present disclosure.

SUMMARY OF THE INVENTION

The present invention discloses a device for dock storage and boat accessible retrieval of a boat docking line comprising a pedestal having a pivotally adjustable and rotatable arm extending therefrom to which a hook is attached at the distal end of said arm. The pedestal includes a base which is fixedly attachable to the dock. In the preferred embodiment of the present invention said arm is segmented with the respective segments of said arm being pivotally attached to each other.

An object of the present invention is to provide safe means for storage of a boat docking line on a dock.

It is also an object of this invention to provide means for retrieval of a boat docking line by a lone person.

A further object of this invention is to provide means for retrieval of a boat docking line while remaining in a boat.

These and other objects and advantages of the present invention will be apparent to those skilled in the art from the following description of a preferred embodiment, claims and accompanying drawings. In the description of the preferred embodiment the terms upper and lower, and proximate and distal are used in reference to the drawings only to facilitate understanding and not as a limitation of the present invention.

DESCRIPTION OF THE PREFERRED EMBODIMENT

Figure 1:
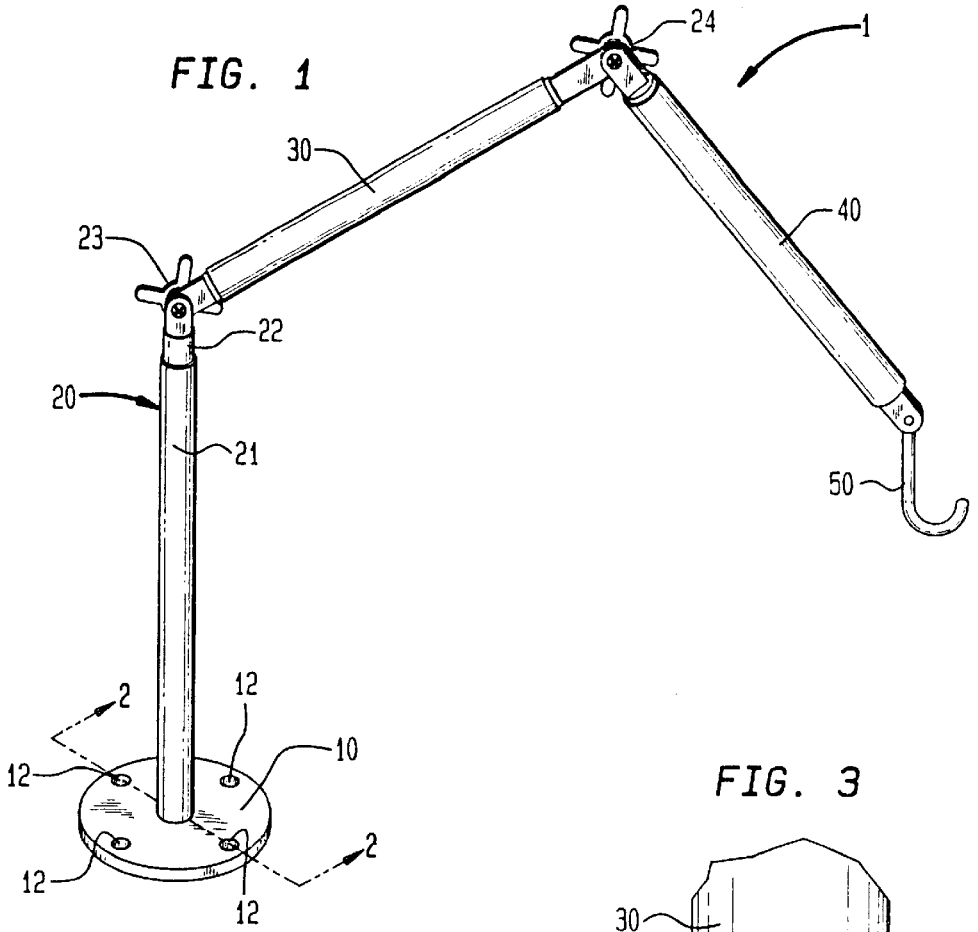
FIG. 1 is a perspective view of the preferred embodiment of the boat docking line holder of the present invention.

FIG. 1 illustrates in a perspective view the preferred embodiment of the boat docking line holder 1 of the present invention. The line holder 1 generally comprises, in combination, a base 10, a pedestal 20 vertically extending from said base 10, a rotatable arm attached to the upper end of said pedestal 20 comprising a first arm segment 30 and a second arm segment 40, and a hook 50 attached to the distal end of said second arm segment 40. The first arm segment 30 is attached at its proximate end in adjustably pivotal engagement with said pedestal 20 by means of first arm segment connector means 23, and said first arm segment 30 is attached at its distal end in adjustably pivotal engagement with said second arm segment 40 by means of second arm segment connector means 24. Hook 50 is rotatably attached to the distal end of said second arm segment 40.

Pedestal 20 comprises an outer cylinder 21 and an inner cylinder 22, said inner cylinder 22 being rotatably telescoped within the upper end of said outer cylinder 21. The upper end of said inner cylinder 22 extends beyond the upper end of said outer cylinder 21 and said first arm segment connector means 23 is attached to the upper end of said inner cylinder 22. The rotatable engagement of said outer cylinder 21 and said inner cylinder 22 permits the arm segments 30 and 40 of the line holder 1 to be rotated while said outer cylinder 21 is fixedly attached to a dock.

Figure 2:
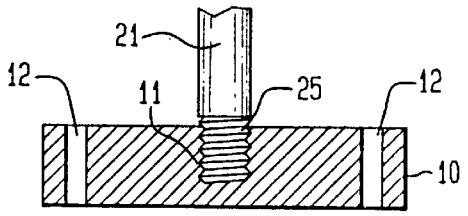
FIG. 2 is a cross-sectional view taken along line A—A of FIG. 1.

Referring now to FIG. 2 it can be seen that the outer cylinder 21 of pedestal 20 is threadedly attachable at its lower end to base 10. Base 10 includes a threaded orifice 11 and a plurality of dock bolt holes 12 disposed about said threaded orifice 11, said dock bolt holes 12 being provided to facilitate fixedly attachment of said base 10 to a dock. The outer cylinder 21 of pedestal 20 includes a threaded lower end portion 25 having threads which are complimentary to the threads formed in the threaded orifice 11 of said base 10 for attachment thereto.

Figure 3:
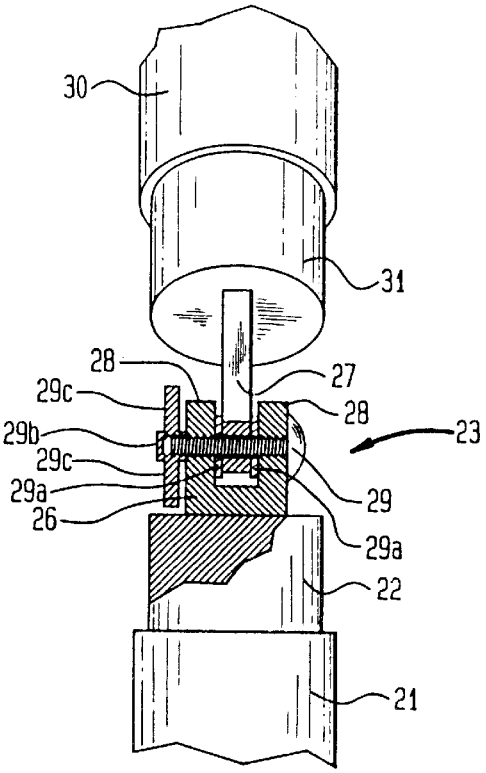
FIG. 3 is an enlarged side plan view of the connector means for the pedestal and the first arm segment of the preferred embodiment.

The first arm segment connector means 23 can be seen in greater detail in FIG. 3. Said first arm segment connector means 23 comprises a tongue and fork assembly which includes a fork 26 integrally formed at the upper end of said inner cylinder 22 and a tongue 27 integrally formed with an end projection 31 extending from the proximate end of said first arm segment 30. Said tongue 27 is disposed between the prongs 28 of said fork 26 and is rotatably attached thereto by means of a threaded bolt 29 which passes through aligned holes formed in said prongs 28 and said tongue 27. Bolt lock washers 29*a* are disposed adjacent to the inside surfaces of said prongs 28 between said prongs 28 and the outside surfaces of said tongue 27. A bolt nut 29*b* provides selective tightening means for said connector means 23 by threaded engagement with the threads of said bolt 29. Said bolt nut 29*b* includes a plurality of wings 29*c* to facilitate hand tightening of said connector means 23. This construction of first arm segment connector means 23 is typical for the second arm segment connector means 24 and provides means for selective pivoting of the respective arm segments 30 and 40.

Figure 4:
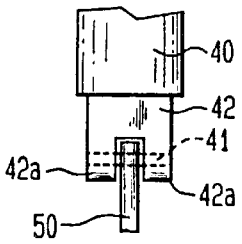
FIG. 4 is a top plan view of the distal end of the second arm segment of the preferred embodiment.

FIG. 4 illustrates in a top plan view of the distal end of said second arm segment 40 the connection of said second arm segment 40 and said hook 50. Second arm segment 40 includes a forked end member 42 formed at its distal end. Hook 50 is rotatably attached to the distal end of said second arm segment 40 by means of a hook pin 41 which extends through the fork prongs 42*a* of said forked end member 42, said hook 50 being disposed between said prongs 42*a*. So attached said hook 50 is disposed to hang vertically regardless of the positions of the arm segments 30 and 40.

For operation of the boat docking line holder 1 of the present invention to provide safe and convenient means of docking and undocking a boat, said line holder 1 is attached to the dock by extending bolts through the bolt holes 12 of said base 10 to fixedly secure said line holder 1 to the dock. The line holder 1 should be secured sufficiently close to the dock's edge so that the arm extends over the edge of the dock. The free end of a docking line is secured to said line holder 1 by wrapping the docking line around the hook 50. A loose knot may be tied in said docking line to prevent the docking line from slipping from said hook 50. The arm segments 30 and 40 are then selectively adjusted by loosening and tightening the arm segment connector means 23 and 24 so that the docking line disposed on said hook 50 can be reached from within the particular boat. Thus when leaving the docking area the docking line may be removed from a boat and secured to the hook 50 of said docking line holder 1 by a lone person from within the boat, and when returning to the docking area the docking line may be reached and tied to the boat from within the boat by a lone person.

Therefore in view of the foregoing I claim:

1. A device for dock storage and boat accessible retrieval of a boat docking line comprising a pedestal fixedly attachable to a dock, said pedestal comprising an outer cylinder and an inner cylinder, said inner cylinder being rotatably telescoped within the upper end of said outer cylinder;

an arm pivotally adjustable and rotatably connected to said pedestal, said arm comprising a first arm segment and a second arm segment, said first arm segment being pivotally connected to said inner cylinder of said pedestal by first arm segment connector means and said second arm segment being pivotally connected to said first arm segment by second arm segment connector means; and a hook rotatably attached to the distal end of said second arm segment.

2. A device for dock storage and boat accessible retrieval of a boat docking line as described in claim 1 wherein said first arm segment connector means comprises a tongue and fork assembly having a fork integrally formed at the upper end of said inner cylinder and a tongue integrally formed with an end projection extending from the proximate end of said first arm segment, said tongue being disposed between the prongs of said fork and rotatably attached thereto by means of a threaded bolt which passes through aligned holes formed in said prongs and said tongue, said connector means further including bolt lock washers disposed adjacent to the inside surfaces of said prongs between said prongs and the outside surfaces of said tongue and a bolt nut providing selective tightening means for said connector means by threaded engagement with the threads of said bolt, said bolt nut including a plurality of wings to facilitate hand tightening of said connector means, and said second arm segment connector means comprises a tongue and fork assembly having a fork integrally formed at the proximate end of said second arm segment and a tongue integrally formed with the distal end of said first arm segment, said tongue being disposed between the prongs of said fork and rotatably attached thereto by means of a threaded bolt which passes through aligned holes formed in said prongs and said tongue, said connector means further including bolt lock washers disposed adjacent to the inside surfaces of said prongs between said prongs and the outside surfaces of said tongue and a bolt nut providing selective tightening means for said connector means by threaded engagement with the threads of said bolt, said bolt nut including a plurality of wings to facilitate hand tightening of said connector means.

3. A device for dock storage and boat accessible retrieval of a boat docking line as described in claim 1 wherein said second arm segment includes a forked end member formed at its distal end and said hook is rotatably connected to the distal end of said second arm segment by means of a hook pin which extends through the fork prongs of said forked end member, said hook being disposed between said prongs.

4. A device for dock storage and boat accessible retrieval of a boat docking line comprising a pedestal fixedly attachable to a dock, said pedestal comprising an outer cylinder and an inner cylinder, said inner cylinder being rotatably telescoped within the upper end of said outer cylinder, the outer cylinder of said pedestal being threadedly attachable at its lower end to a base, said base including a threaded orifice and a plurality of dock bolt holes disposed about said threaded orifice, said outer cylinder of pedestal including a threaded lower end portion having threads which are complimentary to the threads formed in said threaded orifice of said base for attachment thereto;

an arm pivotally adjustable and rotatably connected to said pedestal, said arm comprising a first arm segment and a second arm segment, said first arm segment being pivotally connected to said inner cylinder of said pedestal by first arm segment connector means and said second arm segment being pivotally connected to said first arm segment by second arm segment connector means, said first arm segment connector means comprising a tongue and fork assembly having a fork integrally formed at the upper end of said inner cylinder and a tongue integrally formed with an end projection extending from the proximate end of said first arm segment, said tongue being disposed between the prongs of said fork and rotatably attached thereto by means of a threaded bolt which passes through aligned holes formed in said prongs and said tongue, said connector means further including bolt lock washers disposed adjacent to the inside surfaces of said prongs between said prongs and the outside surfaces of said tongue and a bolt nut providing selective tightening means for said connector means by threaded engagement with the threads of said bolt, said bolt nut including a plurality of wings to facilitate hand tightening of said connector means, and said second arm segment connector means comprising a tongue and fork assembly having a fork integrally formed at the proximate end of said second arm segment and a tongue integrally formed with the distal end of said first arm segment, said tongue being disposed between the prongs of said fork and rotatably attached thereto by means of a threaded bolt which passes through aligned holes formed in said prongs and said tongue, said connector means further including bolt lock washers disposed adjacent to the inside surfaces of said prongs between said prongs and the outside surfaces of said tongue and a bolt nut providing selective tightening means for said connector means by threaded engagement with the threads of said bolt, said bolt nut including a plurality of wings to facilitate hand tightening of said connector means; and a hook rotatably attached to the distal end of said second arm segment, said second arm segment including a forked end member formed at its distal end, said hook being rotatably connected to the distal end of said second arm segment by means of a hook pin which extends through the fork prongs of said forked end member, said hook being disposed between said prongs.

* * * * *